US008900023B2

(12) United States Patent
Wallmark

(10) Patent No.: US 8,900,023 B2
(45) Date of Patent: Dec. 2, 2014

(54) SWIM FIN

(75) Inventor: Andreas Wallmark, Stockholm (SE)

(73) Assignee: Bippo Innovations AB, Stockholm (SE)

( * ) Notice: Subject to any disclaimer, the term of this patent is extended or adjusted under 35 U.S.C. 154(b) by 0 days.

(21) Appl. No.: 13/322,020

(22) PCT Filed: Jun. 2, 2010

(86) PCT No.: PCT/SE2010/050604

§ 371 (c)(1),
(2), (4) Date: Nov. 22, 2011

(87) PCT Pub. No.: WO2010/140965

PCT Pub. Date: Dec. 9, 2010

(65) Prior Publication Data

US 2012/0064785 A1 Mar. 15, 2012

(30) Foreign Application Priority Data

Jun. 3, 2009 (SE) ..... 0900760

(51) Int. Cl.
*A63B 31/11* (2006.01)

(52) U.S. Cl.
CPC ..... *A63B 31/11* (2013.01); *A63B 2031/115* (2013.01)
USPC ..... 441/63

(58) Field of Classification Search
CPC ..... A63B 31/11
USPC ..... 114/61–64; D21/806
See application file for complete search history.

(56) References Cited

U.S. PATENT DOCUMENTS

| | | | | | |
|---|---|---|---|---|---|
| 3,665,535 | A | | 5/1972 | Picken | |
| 4,025,977 | A | * | 5/1977 | Cronin | 441/64 |
| 4,178,128 | A | * | 12/1979 | Gongwer | 416/72 |
| 4,342,558 | A | | 8/1982 | Wilson | |
| 4,781,637 | A | * | 11/1988 | Caires | 441/61 |
| 4,895,537 | A | * | 1/1990 | Ciccotelli | 441/64 |
| 4,934,971 | A | | 6/1990 | Picken | |
| 4,944,703 | A | * | 7/1990 | Mosier | 441/62 |

(Continued)

FOREIGN PATENT DOCUMENTS

| | | | |
|---|---|---|---|
| RU | 1349051 | A1 | 1/1993 |
| WO | WO 94/25116 | A1 | 11/1994 |

OTHER PUBLICATIONS

"Center of Pressure" by NASA, retrieved Dec. 23, 2013, http://www.grc.nasa.gov/WWW/k-12/airplane/cp.html.*

(Continued)

*Primary Examiner* — Stephen Avila
*Assistant Examiner* — Andrew Polay
(74) *Attorney, Agent, or Firm* — Dickstein Shapiro LLP

(57) ABSTRACT

Swim fin (1) comprising a foot portion (2) intended to accommodate and be attached to a user's foot, which foot portion (2) embraces at least one toe portion (3) having a foot sole, at least one arm (4), which is attached to the foot portion (2) and which projects forward, and at least one blade (5), the at least one blade (5) being limitedly pivotally attached to the arm (4). The arm (4) is rigidly attached to at least the toe portion (2) while forming an angle ($\alpha$) defined as the angle between the foot sole and the axial direction of the arm (4), which angle amounts to between approx. 20 and 60°, and that the arm is rigid.

11 Claims, 9 Drawing Sheets

(56) References Cited

U.S. PATENT DOCUMENTS

| | | | | |
|---|---|---|---|---|
| 5,536,190 | A * | 7/1996 | Althen | 441/64 |
| 5,595,518 | A * | 1/1997 | Ours | 441/64 |
| 5,597,138 | A * | 1/1997 | Arlton et al. | 244/17.13 |
| 5,899,781 | A * | 5/1999 | McLaughlin | 441/64 |
| 6,182,377 | B1 * | 2/2001 | Toensing | 36/8.1 |
| 6,568,973 | B2 * | 5/2003 | Testa | 441/64 |
| 2007/0004295 | A1 * | 1/2007 | Rocci | 441/64 |
| 2007/0037459 | A1 * | 2/2007 | McCarthy | 441/64 |

OTHER PUBLICATIONS

"Airfoils and Wings" by Lutze, retrieved Dec. 23, 2013. http://www.dept.aoe.vt.edu/~lutze/AOE3104/airfoilwings.pdf.*

* cited by examiner

SWIM FIN

FIELD OF THE INVENTION

The invention relates to a swim fin comprising a foot portion intended to accommodate and be attached to a user's foot, which foot portion embraces at least one toe portion having a foot sole, at least one arm, which is attached to the foot portion and which projects forward, and at least one blade, the at least one blade being limitedly pivotally attached to the arm.

BACKGROUND OF THE INVENTION

Swim fins are utilized in, e.g., snorkelling and diving, in freediving as well as scuba diving, to convert the principally vertical leg kick of the legs into an improved propulsion and thereby the speed of the body in the water. The swim fins are usually manufactured entirely or partly of rubber and embrace a shoe and a blade. When using swim fins, the blade usually flexes in the opposite direction to the one that the leg moves because of the resistance of the water, which decreases the performance of the swim fin. By the shoe and blade of the swim fin being formed integrally, turbulence also arises in the vicinity of the transition between the foot and the blade, which also is a disadvantage in respect of the performance of the swim fin.

An additional disadvantage of today's fins is that the angle between the foot portion including the attached blade and the direction of travel (as defined in FIG. 6) is small, which impairs the performance of the swim fin. In addition, the blade is usually not shaped as a hydrofoil blade/fin, which further impairs the performance of the swim fin.

Yet a disadvantage of today's swim fins is that it is only possible to swim forward when executing a conventional leg kick. In certain types of diving, e.g., in diving in narrow spaces, such as in caves or inside wrecks, wherein the diver has difficulties in turning around, it would be desirable to be able to convert the usually forwardly acting force of the kick of the leg to a backwardly acting force, i.e., a reverse motion. Also upon ascent, it may in certain cases be desirable with a reverse motion to slow down the ascension speed and thereby decreasing the risk of decompression sickness.

By U.S. Pat. No. 4,934,971, a swim fin is known the blade of which is limitedly pivotally attached to arms, which arms are attached to a foot portion with a relatively large angle between the foot portion and the direction of travel, and the blade of which is in the form of a fin.

By U.S. Pat. No. 5,536,190, a swim fin is known comprising a plurality of hydrofoil blades the angle of attack of which is automatically self-adjusting by the utilization of a negative feedback via one or more hydrodynamic control surfaces.

SUMMARY OF THE INVENTION

The object of the invention is to provide a swim fin by means of which it is possible to entirely or partly eliminate the disadvantages mentioned above.

This object is achieved by a swim fin comprising a foot portion intended to accommodate and be attached to a user's foot, which foot portion embraces at least one toe portion having a foot sole, at least one arm, which is attached to the foot portion and which projects forward, and at least one blade, the at least one blade being limitedly pivotally attached to the arm, and the characteristic of the invention is that the arm is fixedly attached to at least the toe portion while forming an angle defined as the angle between the foot sole and the axial direction of the arm, which angle amounts to between approx. 20 and 60°, and that the arm is rigid.

Preferred embodiments are described in the dependent claims.

BRIEF DESCRIPTION OF THE DRAWINGS

The invention is described in more detail below, reference being made to the accompanying drawing, in which.

DESCRIPTION OF PREFERRED EMBODIMENTS

Figure 1A:
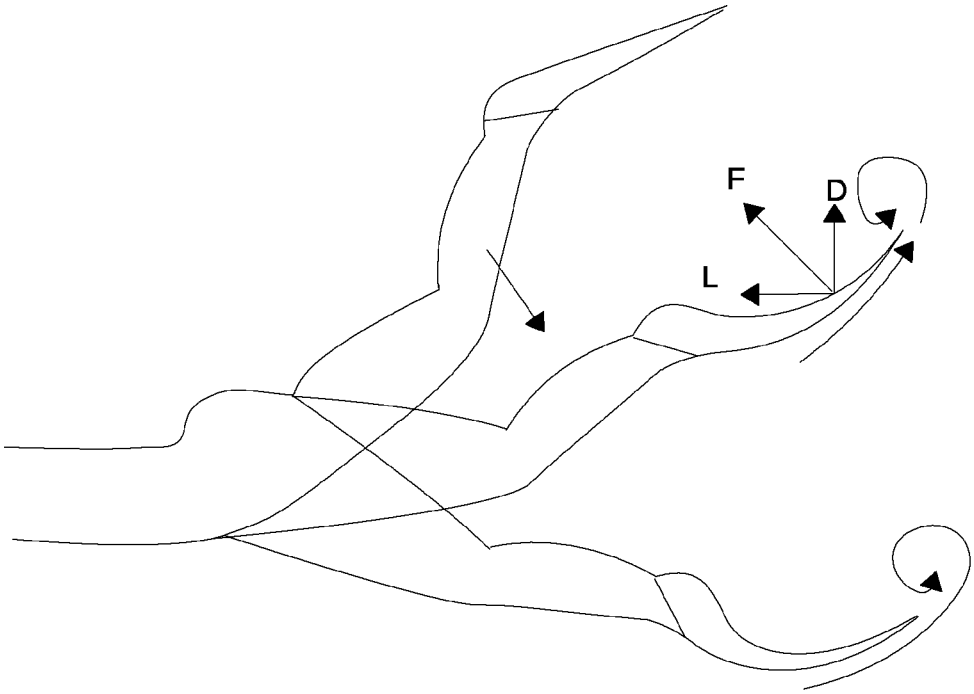
FIGS. 1*a* and 1*b* are schematic views that show the forces that act on a conventional swim fin when executing leg kicks.
Figure 1B:
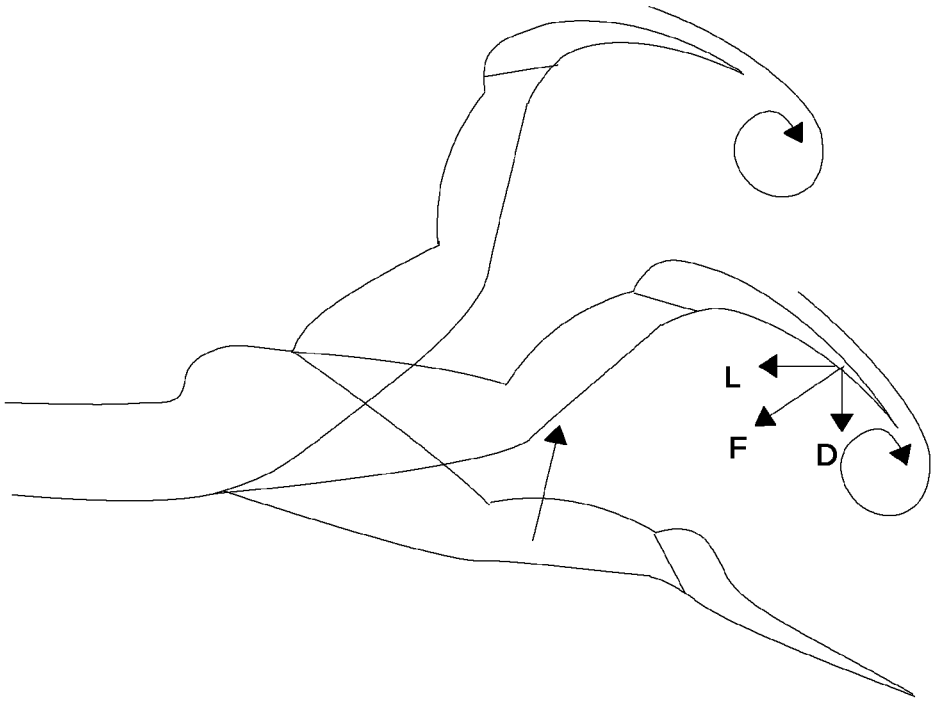

In FIGS. 1*a* and 1*b*, there are shown the forces that arise when executing the leg kick and that act on a conventional swim fin by the resulting water movement. This water movement gives rise to a force F that acts on the swim fin. This force can be divided into a horizontal component L and a vertical component D. It is the horizontal component L that generates driving force forward while D is resistance. An efficient swim fin has a high value of L at the same time as D is small. Accordingly, a measure of the efficiency is the ratio between L and D according to E=L/D. In order for a swim fin to work well, the value of L should be sufficiently great to generate enough propelling force. Simultaneously, E should be great for the swim fin not to be "viscous". It is for this reason that a conventional swim fin has inferior performance than the swim fin according to the invention. Even if L may be sufficient, the resistance is high. The foremost reason for this is that a conventional swim fin only uses "one of the sides" to generate driving force, and more precisely, driving force is generated only from the pressure side.

Figure 2:
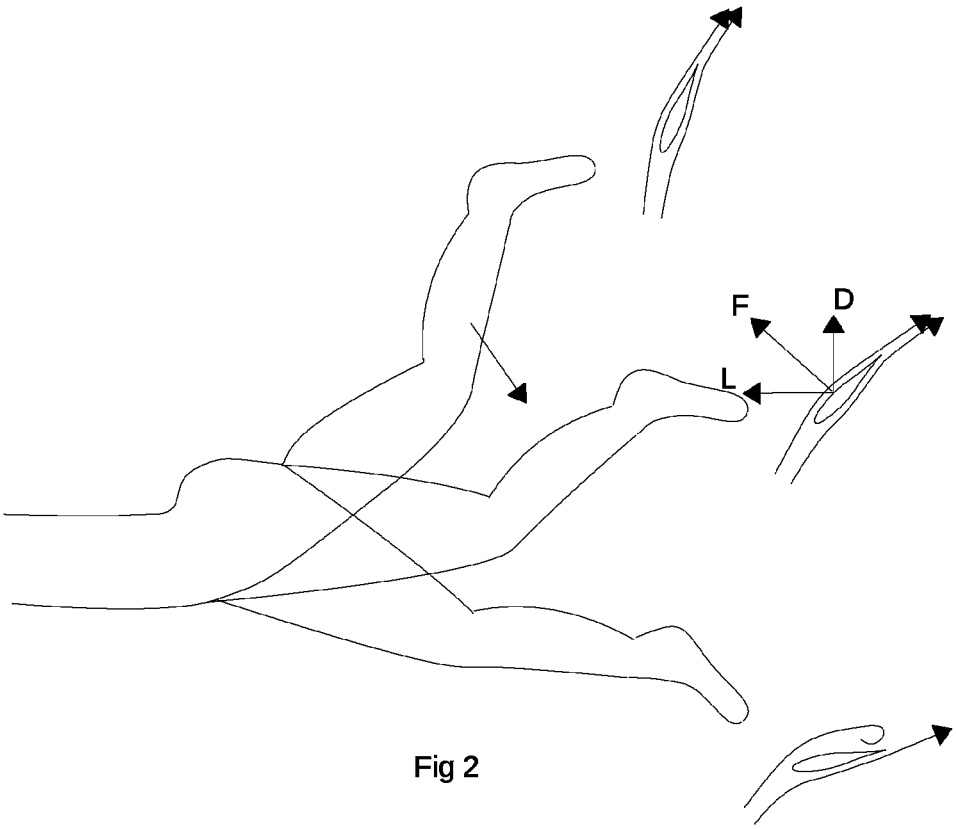
FIGS. 2-5 are schematic views of the forces that act on a swim fin according to the invention when executing leg kicks as well as the angle position of the hydrofoil blade of the swim fin in relation to the foot, only one hydrofoil blade of the swim fin according to the invention being shown.
Figure 3:
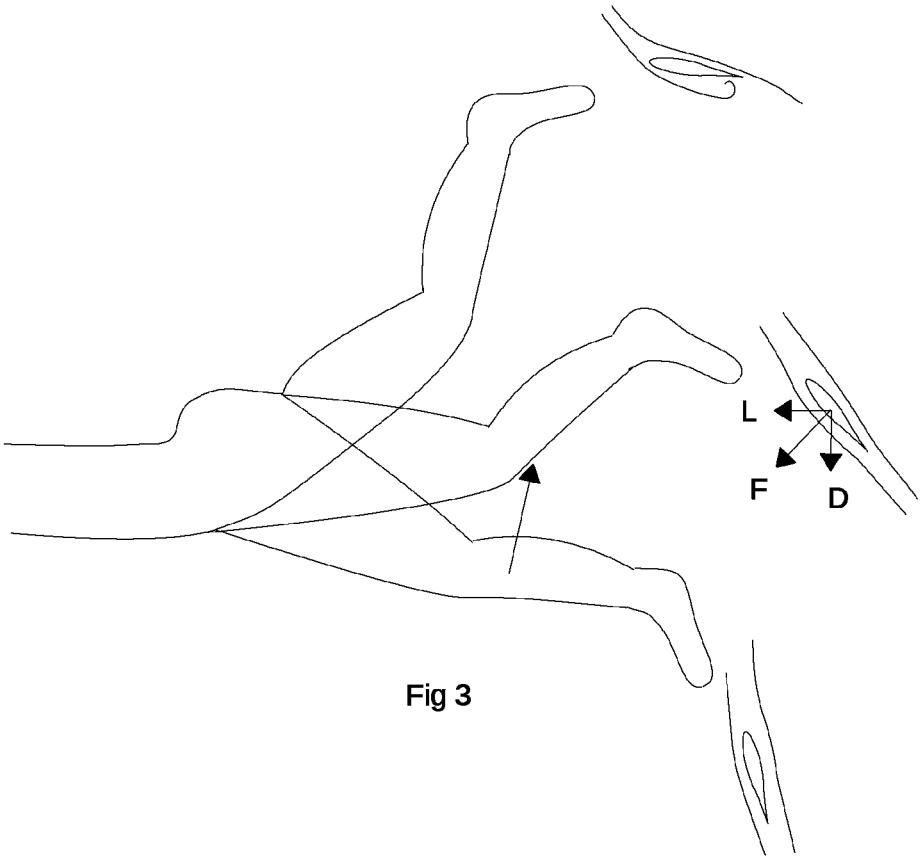

In FIGS. 2 and 3, there are shown the corresponding forces, which arise when executing a leg kick, at a swim fin according to the invention arranged at the foot of the leg, which swim fin only is schematically shown by the hydrofoil blade thereof and only by one hydrofoil blade as well as shown in a state for driving forward.

Figure 4:
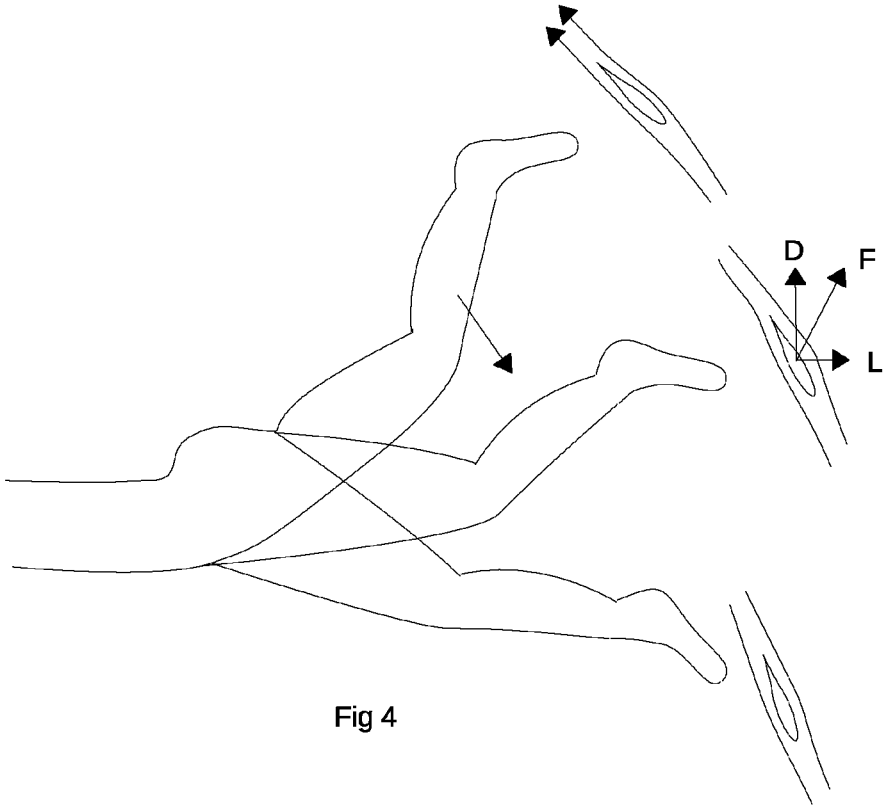
Figure 5:
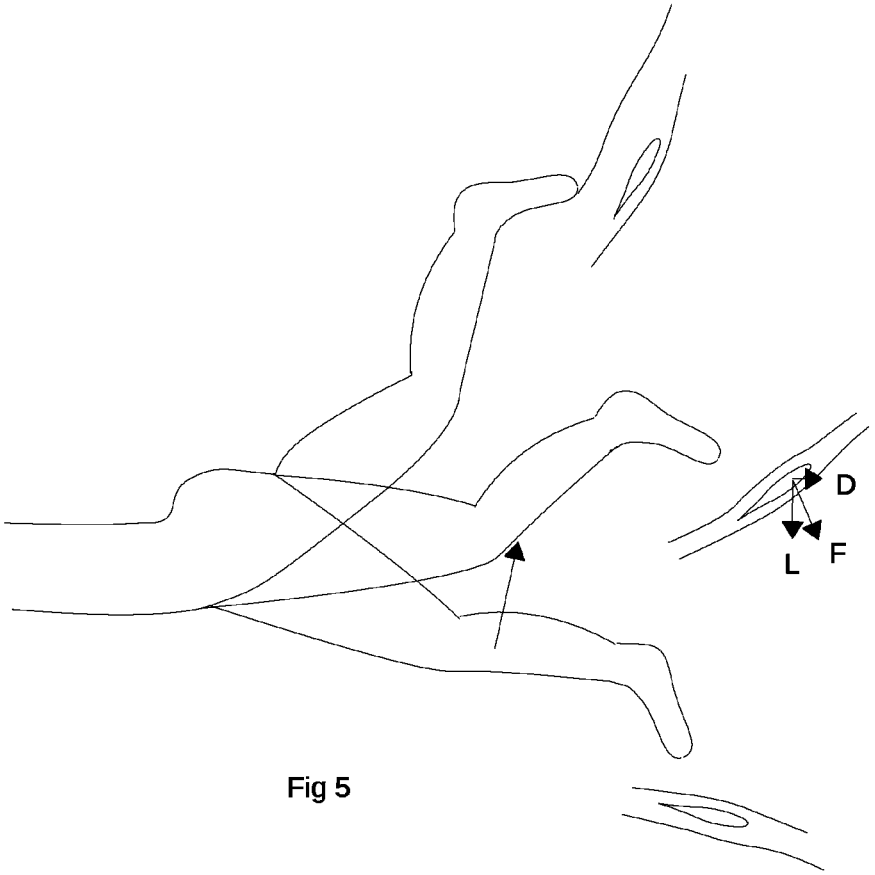

In FIGS. 4 and 5, there are shown the corresponding forces, which arise when executing a leg kick, at a swim fin according to the invention arranged at the foot of the leg, which swim fin only is schematically shown by the hydrofoil blade thereof and only by one hydrofoil blade as well as shown in a state for driving backward.

Figure 6:
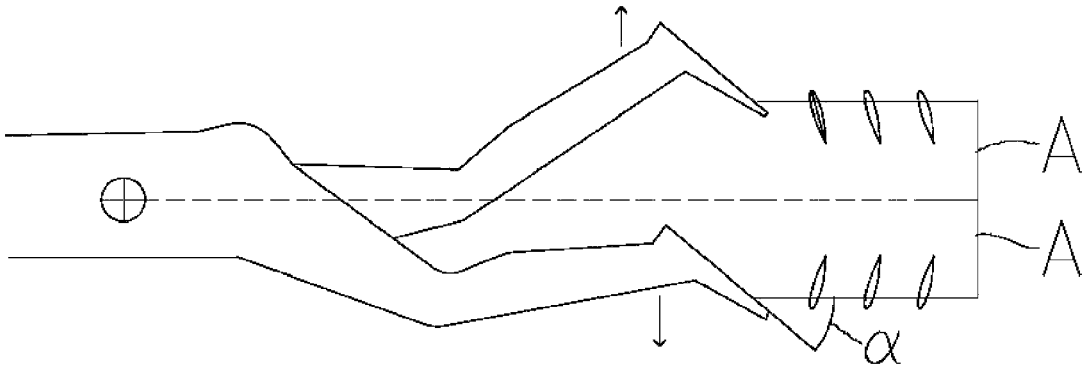
FIG. 6 is a schematic view that shows the angle defined in the application between the foot sole and the direction of travel of a swimming person provided with the swim fin according to the invention, only the hydrofoil blades of the swim fin being schematically shown.
Figure 7A:
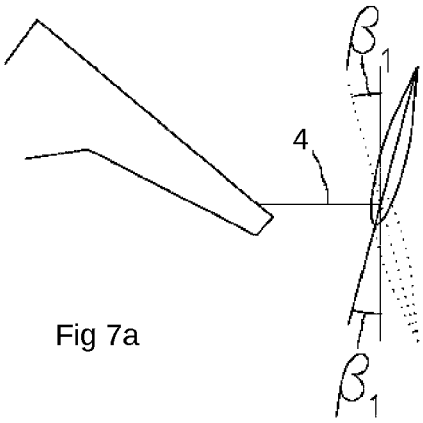
FIGS. 7*a* and 7*b* show suitable angles that a hydrofoil blade can assume when executing leg kicks in order to swim forward (FIG. 7*a*) and backward (FIG. 7*b*)
Figure 7B:
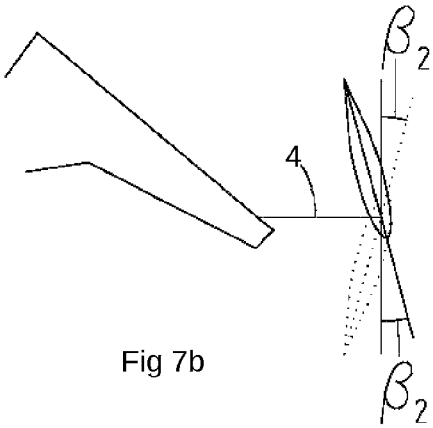

In FIG. 6, there is illustrated the angle $\alpha$ defined in the application between the foot sole and the direction of travel of a swimming person and is assumed be relatively constant, approx. 40°, but it may vary in fixed angle intervals between approx. 20° and approx. 60°. There is further shown the directions of motion of the legs and thereby the directions of the hydrofoil blades of the respective swim fin, when swimming forward. If it is assumed that this angle is maintained when executing the leg kicks, it is, as is seen in FIGS. 7*a* and 7*b*, suitable that the hydrofoil blades during swimming are allowed to pivot between an angle $\beta_1$ when driving forward and an angle $\beta_2$ when driving backward that may vary between approx. 10° and approx. 45° in relation to a plane perpendicular to the longitudinal direction of the arm(s) 4 and depending on how fast versus easily driven fin is desired.

Furthermore, it is assumed that the leg kicks performed are carried out with the same distance A in both directions in relation to the resulting propulsion force of the swimmer, as is seen in FIG. 6.

Figure 8A:
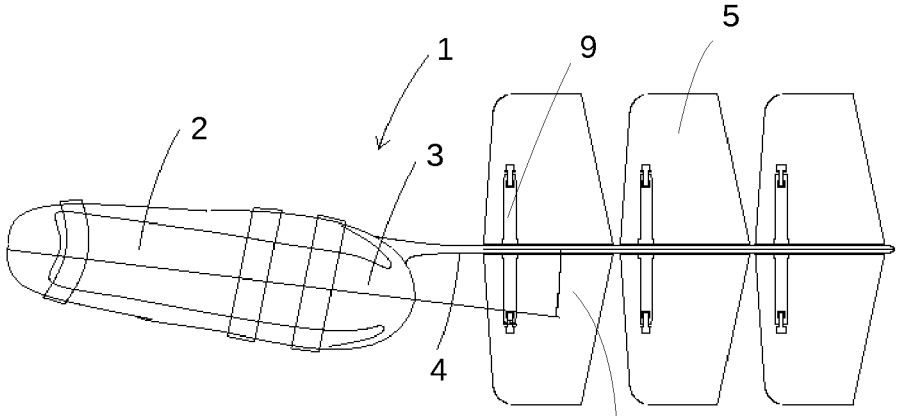
FIG. 8*a* is a schematic view from above of a swim fin according to a first embodiment of the invention provided with three movable hydrofoil blades mounted on an arm, a pivot spindle of the respective hydrofoil blade being shown.
Figure 8C:
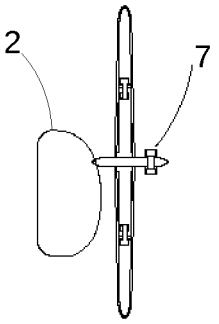
FIG. 8*c* is a sectioned end view with a schematically shown toe portion of the swim fin in FIG. 8*a*.

FIG. 8*a* shows a first embodiment of a swim fin 1 according to the invention comprising a foot portion 2 intended to accommodate and be attached to a user's foot (not shown), which foot portion 2 embraces at least one toe portion 3, one arm 4, which is rigidly attached to the foot portion 2 or the toe portion 3 or a combination thereof and which projects forward, i.e., in the direction of the foot, and at least one blade 5, three ones in the embodiment illustrated, preferably having a symmetric hydrofoil section. In the description below, the blades are 5 denominated hydrofoil blades 5. In the embodiment illustrated, the arm is attached to the toe portion 3. The respective hydrofoil blade 5 is made in the form of two hydrofoil blade halves that are mutually rotationally fixedly attached to each other and pivotally attached to the arm 4 by means of a spindle 9. In FIG. 8*a*, the spindles 9 are revealed, but this is only to simplify the drawing since the same are placed inside the respective hydrofoil blade half, as is seen in FIG. 8*c*.

Figure 8B:
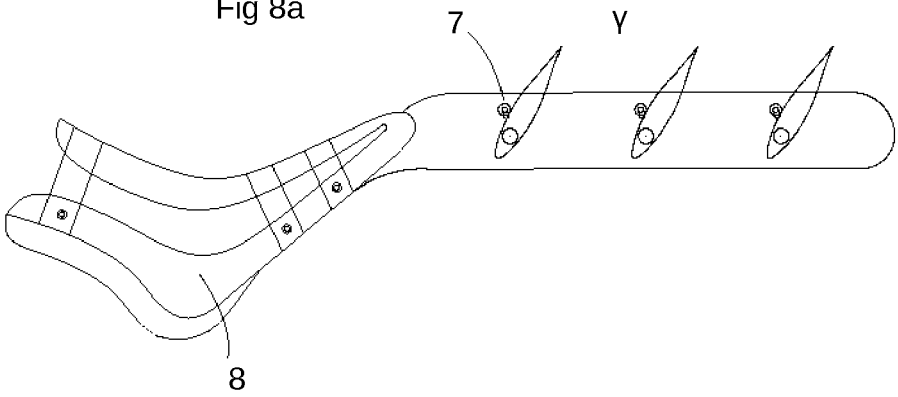
FIG. 8*b* is a schematic side view of a swim fin according to the first embodiment.

As is seen in FIG. 8*b*, the arm 4 is rigidly attached to the toe portion 3, i.e., the toe portion 3 and the arm 4 have all the time the same angle, and form a relatively large angle between the main direction of the foot sole of the foot portion 2 and the main direction of the arm 4, which angle amounts to approx. 20-60°. In the shown first embodiment, the angle amounts to approx. 40°. Furthermore, the foot portion comprises a stiff ankle boot or sport boot 8 that is arranged to extend at least past the ankle of the foot. By providing the swim fin with a sport boot 8, the calf muscle is relieved. By the sport boot, a non desired angulation and turning of the foot is also avoided, so that the foot is held in an optimum position to, in such a way, obtain maximum effect from the fin.

Preferably, the foot portion 2 is, as seen in the longitudinal direction thereof, also angled by an angle $\gamma$ that amounts to approx. 3-7°, preferably 5° (FIG. 8*a*) in relation to the longitudinal direction of the arm 4 because of the foot tending to turn inward when leg kicks are carried out.

The respective hydrofoil blade 5 is limitedly pivotally attached to the arm 4 in such a way that they can move, i.e., be pivoted by means of spindle between two end positions depending on the leg kick carried out, as is schematically shown in FIGS. 7*a* and 7*b*. The angle, i.e., the angular deflection, that the hydrofoil blade can move between will be described in more detail below. In the first embodiment, this angle is limited by a stopper member 7 for each hydrofoil blade, see FIGS. 8*b* and 8*c*.

Figure 9:
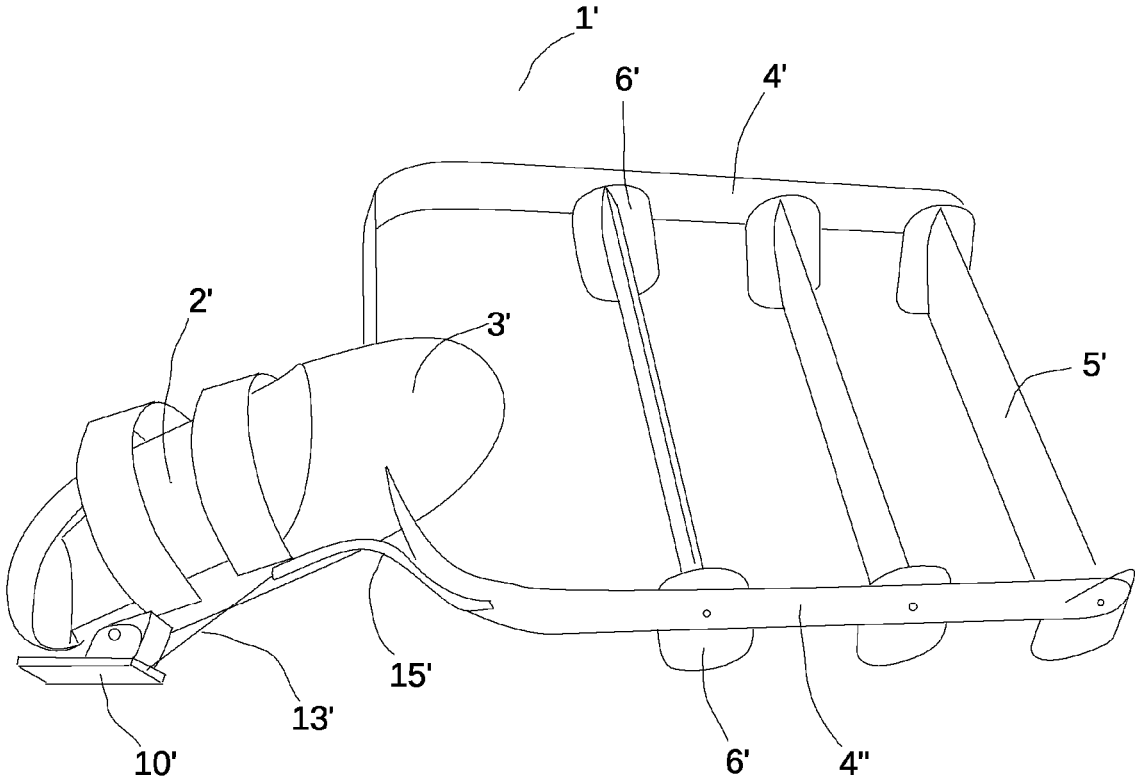
FIG. 9 is a schematic perspective view of a swim fin according to a second embodiment of the invention provided with opposite arms with three movable hydrofoil blades mounted between the arms and shown in a state to swim forward.
Figure 10A:
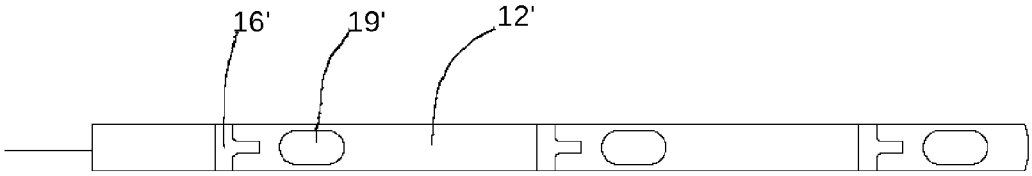
FIGS. 10*a* and 10*b* are a side view and a view from above, respectively, of a lock strip of a mechanism for the change-over of the swim fin shown in FIG. 9 between driving forward and backward, which lock strip is shown adapted to a swim fin having three hydrofoil blades.
Figure 10B:
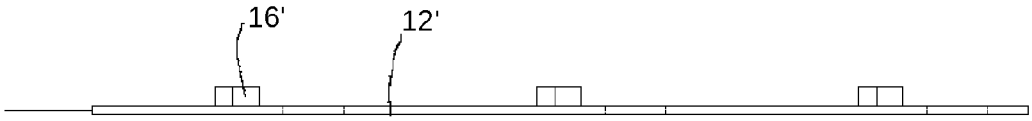

In FIG. 9, a second embodiment is shown of a swim fin 1' according to the invention, which comprises a foot portion 2' intended to accommodate and be attached to a user's foot (not shown), which foot portion 2' embraces at least one toe portion 3', opposite arms 4', 4", which are rigidly attached to the foot portion 2' or the toe portion 3' or a combination thereof and which project forward, i.e., in the direction of the foot, and at least one hydrofoil blade 5', three ones in the embodiment illustrated, preferably having a symmetric hydrofoil blade section. In the embodiments shown, the arms are rigidly attached to the toe portion 3'. In the same way as in the first embodiment, the angle between the foot sole of the foot portion 2' and the main direction of the arms 4', 4" amounts to approx. 20-60°, particularly 40°.

It is obvious that the swim fin 1' shown in FIG. 9 may be provided with an ankle boot or sport boot, which is shown in FIG. 8*b*.

Furthermore, as is seen in FIG. 9, the hydrofoil blades 5' are, at the respective side edges thereof, provided with end wall portions 6'. The object of the end wall portions 6' is to confine the water flow over the hydrofoil blades and thereby eliminate an undesired flow pattern, turbulence, at the side edges of the hydrofoil blades 5'. In this way, the swim fin 1' gets a further improved performance.

Furthermore, the hydrofoil blade 5, 5' are preferably formed hollow and provided with holes, not shown, so that water can penetrate into and out of the same. The hydrofoil blades 5, 5' are preferably neutrally balanced in the water, i.e., they should have a density that is as close to the density of the water as possible and manufactured from an incompressible material.

By replacing the blade of a conventional swim fin with limitedly pivotable hydrofoil blades according to the invention, it is also possible to provide a reverse function of the swim fin.

In the description below of the reverse function, reference is made to the second embodiment, but it is obvious for a person skilled in the art that a corresponding reverse function can be achieved in a swim fin according to the first embodiment.

For the change-over of the swim fin 1' between a state for driving forward and a state for driving backward, reverse, the swim fin is provided with a change-over mechanism, which is seen in FIGS. 10*a*-12*b* and which comprises an actuation handle 10' preferably arranged at the foot portion 2' of the swim fin and mounted to the same. One 4" of the arms preferably forms a part of the same change-over mechanism.

Figure 11A:
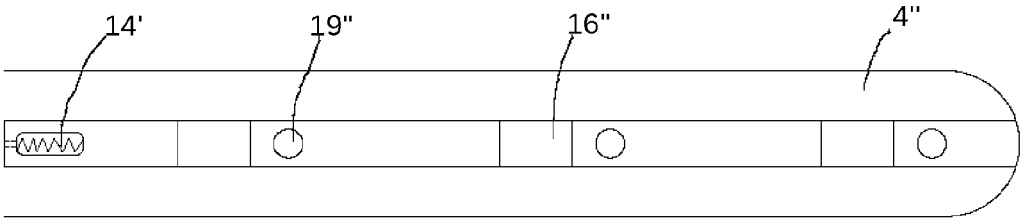
FIGS. 11*a* and 11*b* are a side view and a view from above, respectively.
Figure 11B:
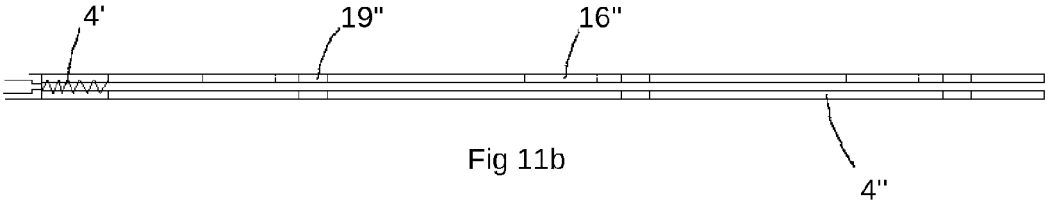
Figure 11C:
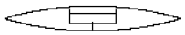
FIG. 11*c* is an end view of one of the opposite arms in the form of a housing for the accommodation of the lock strip of the mechanism for the change-over of the swim fin shown in FIG. 9 between driving forward and backward, which housing is shown adapted to a swim fin having three hydrofoil blades with and without a lock strip.
Figure 12A:
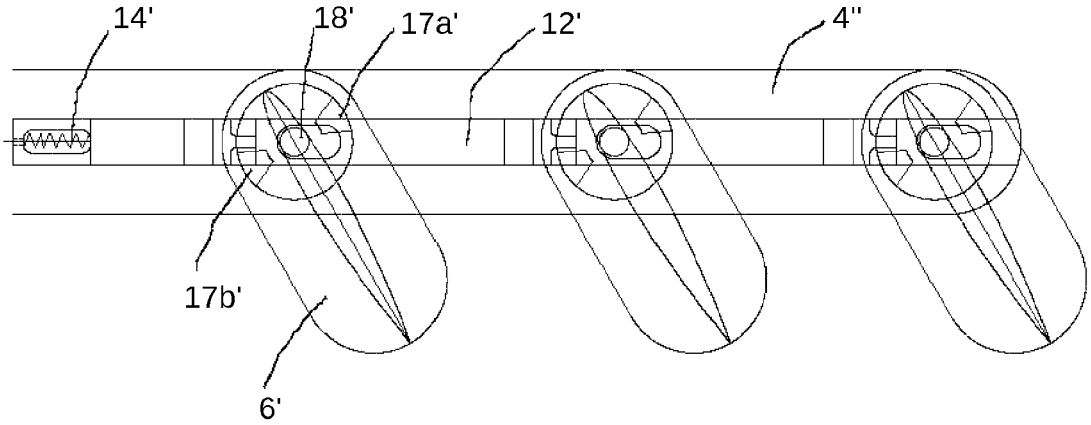
FIG. 12*a* is a schematic side view of the three hydrofoil blades of the swim fin in FIG. 9 mounted to an arm and with a stop shoulder of the respective hydrofoil blade abutting against a lock shoulder of the lock strip and shows all parts "on top of each other"
Figure 12B:
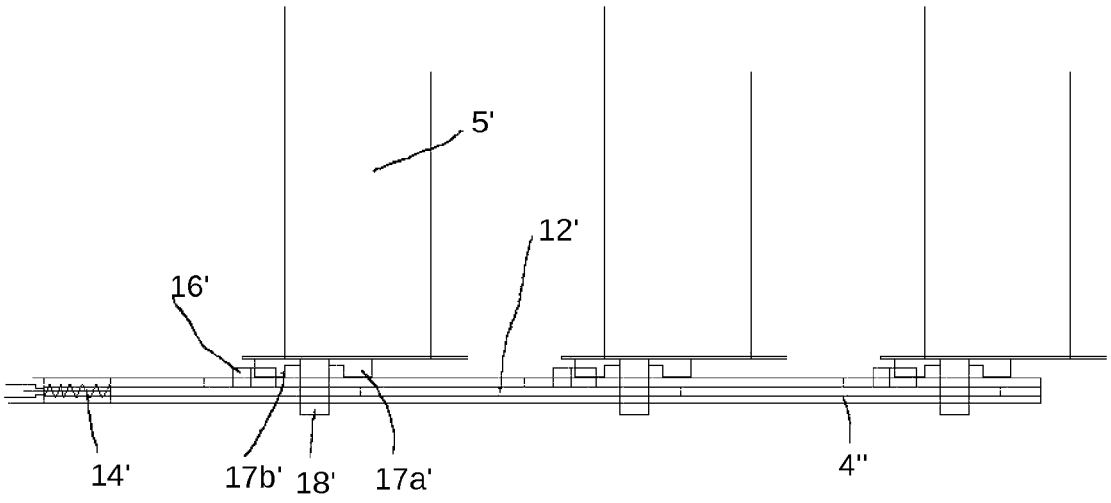
FIG. 12*b* is a broken schematic view from above of the view in FIG. 12*a*.

The arms 4', 4" of the swim fin are formed with an acute oval cross-section (FIG. 11*c*). On the inside of one of the arms, more precisely the arm 4", a lock strip 12' is displaceably arranged in a suitable groove. The lock strip 12' is preferably biased by means of a spring 14' toward the active state thereof, i.e., the arresting state thereof, which is shown in FIG. 12*a* for driving forward, and actuatable between a locking state and an idle state by means of the actuation handle 10'. Preferably, a wire or thread 13' extends in a suitable casing or tube 15' between the actuation handle and the lock strip for the actuation of the same.

As is seen in FIGS. 10*a* to 12*b*, the lock strip 12' is provided with lock shoulders 16', which are arranged to co-operate, on one hand, with preferably two stop shoulders 17'*a*, 17'*b* centred on a pivot 18' arranged at the respective side of the hydrofoil blades 5', and on the other hand preferably quadrangular holes 16" in the arm 4". The pivots 18' are intended for the pivotal attachment of the hydrofoil blades 5' at the respective arm 4', 4", which are provided with journaling members/holes 19" complementary to the pivots 18'. The journaling members/holes 19" are arranged right opposite the corresponding journaling members/holes 19' in the lock strip 12', however the last-mentioned journaling members/holes 19' being oval to allow displacement of the lock strip upon change-over of the driving state of the swim fin. The pivots 18' are arranged at the centre of rotation of the hydrofoil blade 5', as is defined below, and have preferably such a length that it extends through the journaling members/holes 19' in the lock strip as well as the journaling members/holes 19" in the arms 4', 4". Between the stop shoulders 17'*a*, 17'*b*, the same have two spaces that correspond to the play or angular motion that can be imparted to the hydrofoil blade 5' when executing leg kicks up and down. This angular motion is limited by the respective lock shoulder 16', against which, in the active state thereof, the respective end surface of the stop shoulders will abut in the respective end position of the hydrofoil blades 5', as is seen in FIG. 12*a*, this figure showing all parts on top of each other to make it possible to see how they fit together and their mutual relationship.

By retracting the lock strip by means of the actuation handle 10', the respective lock shoulder 16' is detached from engagement with the stop shoulders 17'*a*, 17'*b*, wherein the hydrofoil blades 5' can rotate freely. The displacement of the lock strip 12' in the arm 4" is limited by the displacement of the lock shoulders 16' in the holes 16".

As is seen in FIG. 9, the length of the arms 4', 4", counted from the outermost tip of the toe portion 3', should be such that the hydrofoil blade 5' closest to the toe portion freely can be pivoted around the fulcrums thereof arranged at the arms. Furthermore, the distance between the fulcrums 19' is adapted according to the chord length of the hydrofoil blades so that the same freely can be pivoted around.

Below, the function and the advantages of a swim fin 1, 1' provided with hydrofoil blades are described. In the description below, one hydrofoil blade is indicated, but it is obvious that the same advantages are achieved in a swim fin having several hydrofoil blades.

More precisely, one hydrofoil blade is a considerably better alternative than a conventional fin/blade. A hydrofoil blade section, which is correctly formed, utilizes the pressure side as well as suction side to generate force, wherein the force contribution from the suction side often is several times greater than from the pressure side, if it is assumed that it is possible to fix this hydrofoil blade as regards position and rotation in relation to the foot. Furthermore, it is assumed that said rotation is different if the fin is moved upward or downward, or if driving force is wanted forward or backward, the flow and force situation looking like as is seen in FIGS. 2-5. Therefore, the forces of a swim fin according to the invention give rise to a considerably better effect than the forces of a conventional swim fin.

In order for a one-hydrofoil blade solution to work well, the hydrofoil blade area has to be sufficiently large to be able to generate enough force to accelerate the diver. The area of the hydrofoil blade is determined by the hydrofoil blade width as well as the chord length. Then, the active part of the swinging motion has to be sufficiently great in order for the force to have time to act, i.e., the hydrofoil blade has to have time to pivot between the respective end position. By asymmetrical location of the hydrofoil blade in relation to the foot, the area can be increased thanks to the fact that it then is possible to increase the hydrofoil blade width somewhat. It is also possible to increase the chord length. By increased chord length, the area increases, but simultaneously the active part of the swinging motion is decreased. In order to compensate for this decrease of the active part, the angle $\beta_1$ can be increased. However, if the angle is increased too much, the hydrofoil blade stalls, i.e., a separation of the flow is obtained on the suction side and the driving force decreases at the same time as the resistance increases considerably. This phenomenon is particularly evident when accelerating from stationary when the diver's own speed does not contribute to decreasing the angle of attack. It is true that it is possible to make a one-hydrofoil blade solution that is better than a conventional fin, but it is not possible to find an optimum combination of chord length and angle of attack $\beta_1$ with only one hydrofoil blade. However, by dividing the area into a plurality of hydrofoil blades, it is possible to provide a small chord length and a sufficiently small angle $\beta_1$ at the same time as the total hydrofoil blade area becomes sufficiently large. A multi hydrofoil blade solution increases the efficiency of the fin considerably.

In order to further improve the efficiency of the swim fin according to the invention, it is possible to optimize the hydrofoil blade section. In addition, the hydrofoil blade can have a symmetrical or asymmetrical section, but since it is desired that it should function equally well forward as backward, the selection will be a symmetrical section. Since the section is to be utilized in water, it is suitable to use a section intended for water applications, a so-called "hydrofoil". Furthermore, the hydrofoil blade shall work in a wide range of angles of attack, which makes that a "fairly thick" hydrofoil blade should be selected. A preferred hydrofoil blade section is a Selig S8035 section.

Concerning the angular deflection when the swim fin is moving upward and downward, it can be observed that this will be different for driving forward in comparison with driving backward. This depends on the movement of the foot when driving forward describing a circular movement with the centre of the circle in front of the foot. The foot moves toward the centre of curvature. When driving backward, the foot moves from the centre of curvature. The optimization point should be when the hydrofoil blade is in the middle position in FIGS. 2-5. This is when the hydrofoil blade has the greatest speed, the horizontal force component of the hydrofoil blade intersecting the centre of gravity of the swimmer/diver, as well as the leg "hiding" behind the diver and causing the smallest resistance. The desired speed of the diver affects the selection of angular deflection. A faster diver utilizes a smaller angular deflection. Another important thing to take into consideration here is that it takes a part of the swinging motion to rotate the hydrofoil blade from one position to another. The greater the angular deflection between the end positions, the greater part of the swinging motion is taken to rotate the hydrofoil blade and it is only in the end positions that the hydrofoil blade can generate force. One way to decrease the non-active part of the swinging motion is to decrease the chord length of the hydrofoil blade. If the hydrofoil blade width is the same, this also makes that the efficiency of the hydrofoil blade increases at the same time as the force decreases. Thus, it is not possible to find an optimum for all divers and all diving situations, and therefore it is suitable to have variable end positions that can be tried out individually. A suitable initial position may be the following:

If first a neutral plane is defined as a plane perpendicular to the longitudinal direction of the arms 4,4', 4", then for driving forward and backward, respectively, it applies that the hydrofoil blade will move between an angle $\beta_1$ and $\beta_2$, respectively, of approx. 10° to approx. 45°, see FIGS. 7*a*, 7*b*.

Figure 13:
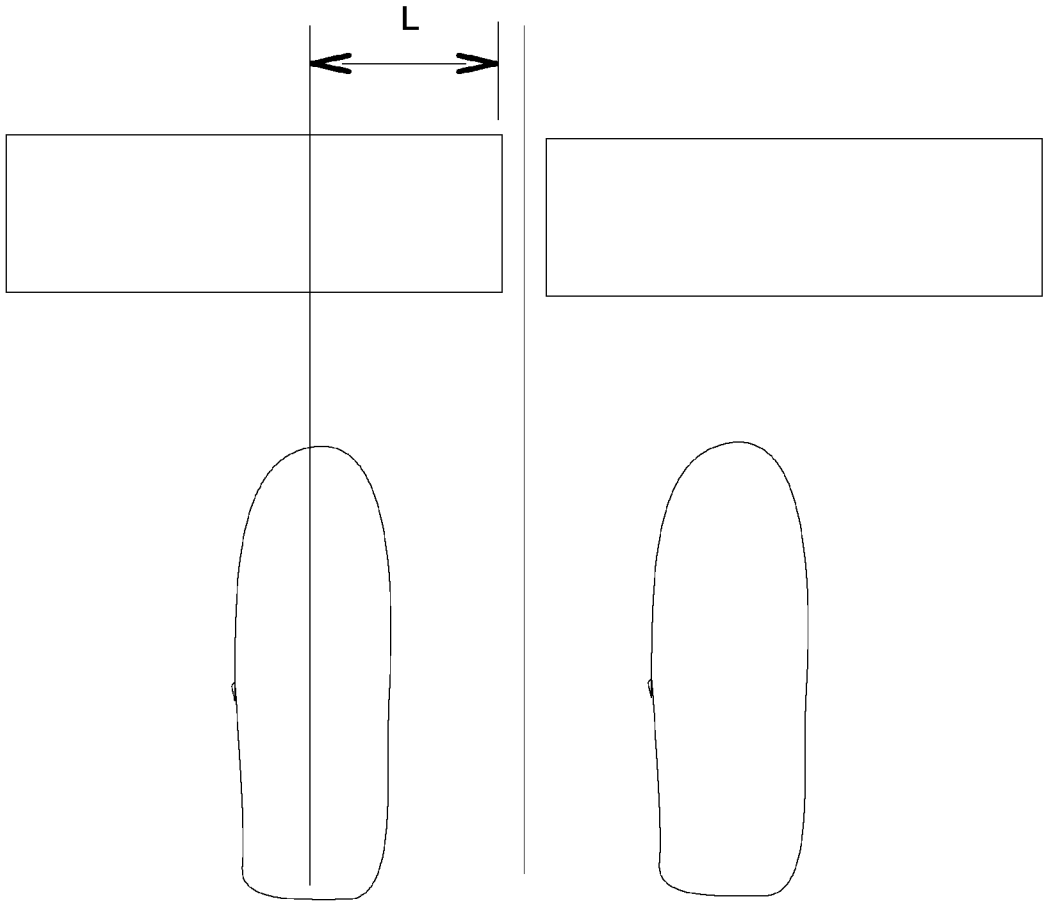
FIG. 13 is a schematic view of the asymmetrical preferred location of a hydrofoil blade in relation to the feet of a user of swim fins formed according to the invention.
Figure 14:
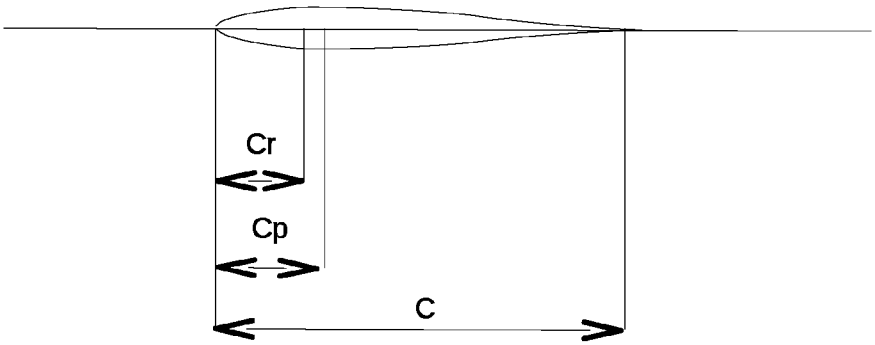
FIG. 14 is a schematic side view of terms used in connection with a hydrofoil blade.

In FIG. 13, it is shown where the rotation axis Cr and centre of pressure Cp are situated on a hydrofoil blade section having a chord length C. A centre of pressure Cp of a section is usually defined as 25% of the chord length counted from the front edge of the section. This may vary a bit from section to section and also depending on the angle of attack, but it is a good indicative value. In order for the hydrofoil blade to work, the location Cr of the rotation axis has to be in front of Cp. Simultaneously, it applies that the longer the distance is between Cr and Cp, the greater the part of the swinging motion is that has to be used to rotate the hydrofoil blade from one end position to another. The load on the change-over mechanism also increases with increased distance between Cp and Cr. A suitable value of Cr then ought to be 20% of the chord length from the front edge. Then the distance between Cp and Cr is small at the same time as it guarantees the desired function.

In order for the fins not to hit each other, the fins must not be too wide, or, more correctly, they must not protrude too much on the inside. Simultaneously, it is the fact that a wider hydrofoil blade is more efficient. But if a stable fixing of the hydrofoil blade on the foot is made, a certain asymmetrical location is acceptable, which in turn enables a wider hydrofoil blade without they hitting each other. The hydrofoil blade should not protrude more than a distance L amounting to 8-16 cm, preferably 12 cm, to the inside counted from the middle of the foot, see FIG. 12.

Even if it in the description above is mentioned that the swim fin of a preferred embodiment should be provided with three hydrofoil blades, it is obvious that it may have fewer or more than three hydrofoil blades, e.g., two or four hydrofoil blades.

The invention claimed is:

1. Swim fin comprising a foot portion in the form of a sport boot that extends at least past an ankle of a user of the swim fin so as to transform a force from a lower leg to the swim fin, wherein two mutually spaced apart arms are rigidly attached to the sport boot, whereby said arms and said sport boot are formed integrally, at least one blade being limitedly pivotally attached relative to the arms and extending between the same, wherein said arms projects forward while forming a first angle defined as the angle between a foot sole and an axial direction of the arm, wherein the first angle is between 20 and 60°, wherein said swim fin further comprises a change-over mechanism to allow change-over of said blade between two fixed angle intervals for the provision of forwardly acting and backwardly acting, respectively, motion of the swim fin when executing leg kicks for forward motion, and wherein at one arm, the change-over mechanism comprises an actuation handle, a lock strip having lock shoulders, which lock strip is biased by means of a spring toward an arresting state of the lock strip, and wherein the lock strip is actuatable by means of the actuation handle under mediation of an actuation member between a locking state, in which the blade can move between fixed angle intervals and in which it is arranged to co-operate with stop shoulders arranged at one side of the blade, and an idle state in which the blade is freely rotatable.

2. Swim fin according to claim 1, wherein the first angle amounts to 40°.

3. Swim fin according to claim 1, wherein said blade is formed as a hydrofoil blade having a symmetric hydrofoil blade section.

4. Swim fin according to claim 3, wherein the hydrofoil blade section is a Selig S8035 section.

5. Swim fin according to claim 1, wherein the blade is placed asymmetrically in relation to the sport boot.

6. Swim fin according to claim 1, wherein the blade is hollow and intended to be filled with water during diving.

7. Swim fin according to claim 1, wherein end wall portions are arranged at the side edges of the blade.

8. Swim fin according to claim 1, wherein the two fixed angle intervals, defined in relation to a plane perpendicular to the axial direction of the arm, are , when driving forward and reverse, respectively, between 10° and 45°.

9. Swim fin according to claim 1, wherein the sport boot in the axial direction thereof is angled by a second angle in relation to the axial direction of the arm.

10. Swim fin according to claim 9, wherein said second angle is 3-7°.

11. Swim fin according to claim 10, wherein said second angle is 5°.

* * * * *